US006536541B2

(12) United States Patent
Pedrelli

(10) Patent No.: US 6,536,541 B2
(45) Date of Patent: Mar. 25, 2003

(54) BORING UNIT FOR PILE FOUNDATIONS

(75) Inventor: Marco Pedrelli, Cesena (IT)

(73) Assignee: Soilmec S.p.A., Cesena (IT)

( * ) Notice: Subject to any disclaimer, the term of this patent is extended or adjusted under 35 U.S.C. 154(b) by 0 days.

(21) Appl. No.: 09/836,803

(22) Filed: Apr. 17, 2001

(65) Prior Publication Data

US 2002/0092683 A1 Jul. 18, 2002

(30) Foreign Application Priority Data

Jan. 17, 2001 (IT) ..... TO2001A032

(51) Int. Cl.[7] ..... E21B 1/00

(52) U.S. Cl. ..... 175/135; 166/77.52; 166/75.14; 173/165; 175/162; 175/202; 175/203

(58) Field of Search ..... 175/161, 162, 175/202, 203, 219, 220, 135, 195; 173/185; 166/77.1, 77.51, 77.52, 85.1, 85.5, 78.1, 75.14

(56) References Cited

U.S. PATENT DOCUMENTS

| | | | | | |
|---|---|---|---|---|---|
| 3,464,507 | A | * | 9/1969 | Alexander et al. | 166/77.52 |
| 3,535,985 | A | * | 10/1970 | Attebo | 173/147 |
| 3,705,634 | A | * | 12/1972 | Casagrande | 173/28 |
| 3,719,238 | A | * | 3/1973 | Campbell et al. | 173/147 |
| 3,734,210 | A | * | 5/1973 | Wilderman | 175/219 |
| 3,766,996 | A | * | 10/1973 | Moody et al. | 137/355.17 |
| 3,869,003 | A | * | 3/1975 | Yamada et al. | 173/156 |
| 4,057,117 | A | * | 11/1977 | Bermingham | 175/161 |
| 4,137,974 | A | * | 2/1979 | Decker | 173/147 |
| 4,150,727 | A | * | 4/1979 | Shepherd | 173/147 |
| 4,503,917 | A | * | 3/1985 | Hargenrader et al. | |
| 4,703,811 | A | * | 11/1987 | Lam | 173/164 |
| 4,785,892 | A | * | 11/1988 | Luen | 173/28 |
| 4,971,162 | A | * | 11/1990 | Back | 175/103 |
| 4,989,677 | A | * | 2/1991 | Lam | 173/1 |
| 5,297,833 | A | * | 3/1994 | Willis et al. | 175/162 |
| 5,343,962 | A | * | 9/1994 | Daigle et al. | 173/141 |
| 5,501,287 | A | * | 3/1996 | Loeser | 175/173 |
| 5,944,452 | A | * | 8/1999 | Reinert, Sr. | 173/184 |
| 6,079,906 | A | * | 6/2000 | Herrero Codina | 175/113 |
| 6,112,834 | A | * | 9/2000 | Barrett | 175/162 |
| 6,234,719 | B1 | * | 5/2001 | Roynestad | 173/1 |
| 6,263,985 | B1 | * | 7/2001 | Scheid et al. | 173/29 |
| 2001/0009204 | A1 | * | 7/2001 | Stansfield | 175/23 |
| 2001/0032741 | A1 | * | 10/2001 | Sherwood | 175/162 |
| 2002/0043403 | A1 | * | 4/2002 | Juhasz et al. | 175/40 |
| 2002/0074132 | A1 | * | 6/2002 | Juhasz et al. | 166/380 |

FOREIGN PATENT DOCUMENTS

| | | | | | |
|---|---|---|---|---|---|
| DE | 3338144 | A1 | * | 10/1984 | E02D/13/02 |
| JP | 56006825 | A | * | 1/1981 | E02D/7/00 |
| JP | 60043523 a | | * | 3/1985 | E02D/7/16 |
| JP | 04047022 | A | * | 2/1992 | E21B/15/00 |
| JP | 60112924 | A | * | 6/1995 | E02D/7/16 |

* cited by examiner

*Primary Examiner*—David Bagnell
*Assistant Examiner*—Jennifer H Gay
(74) *Attorney, Agent, or Firm*—Merchant & Gould, P.C.

(57) ABSTRACT

Boring unit for pile foundations presenting a tracked vehicle facing the mouth of a hole, a mast (5) which is supported by the tracked vehicle, a rotary table (6) which is slidingly mounted along the mast (5), and at least one excavation element (7) which is connected to the table (6) and which presents a boring tool (8) at its own lower end. The boring unit may also include a handling device (11) which provides for moving the excavation element (7) and for moving further auxiliary excavation elements (19, 20) and which is also provided with a head (12) mounted on a top end of the mast (5) that is equipped with a hoist (13) and a central cable (14) which can be alternatively connected to the excavation element (7) via a drive unit (40) which is suitable for co-operating with the hoist (13) in order to rapidly move the auxiliary excavation elements.

15 Claims, 9 Drawing Sheets

Fig.1
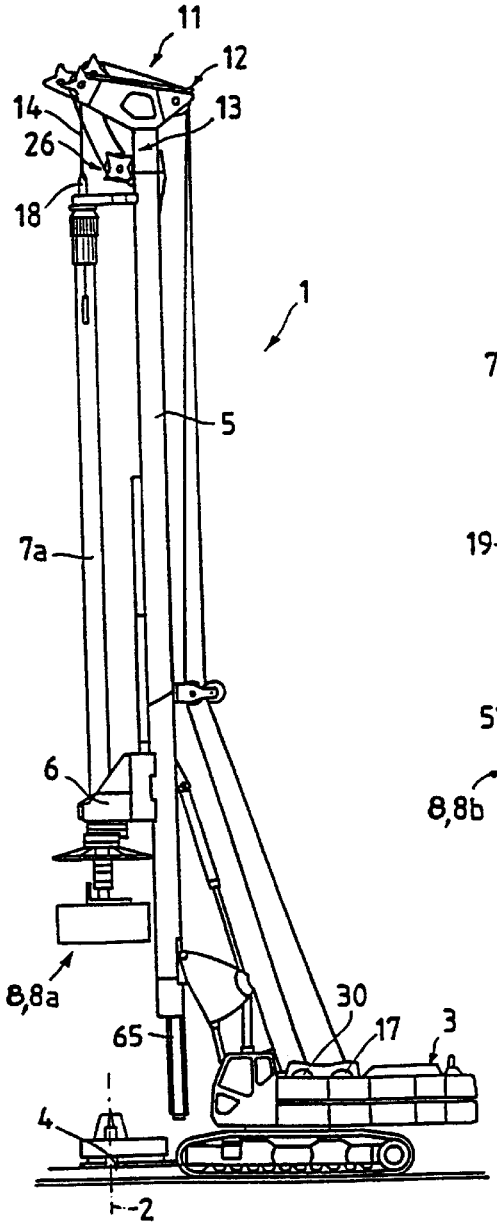
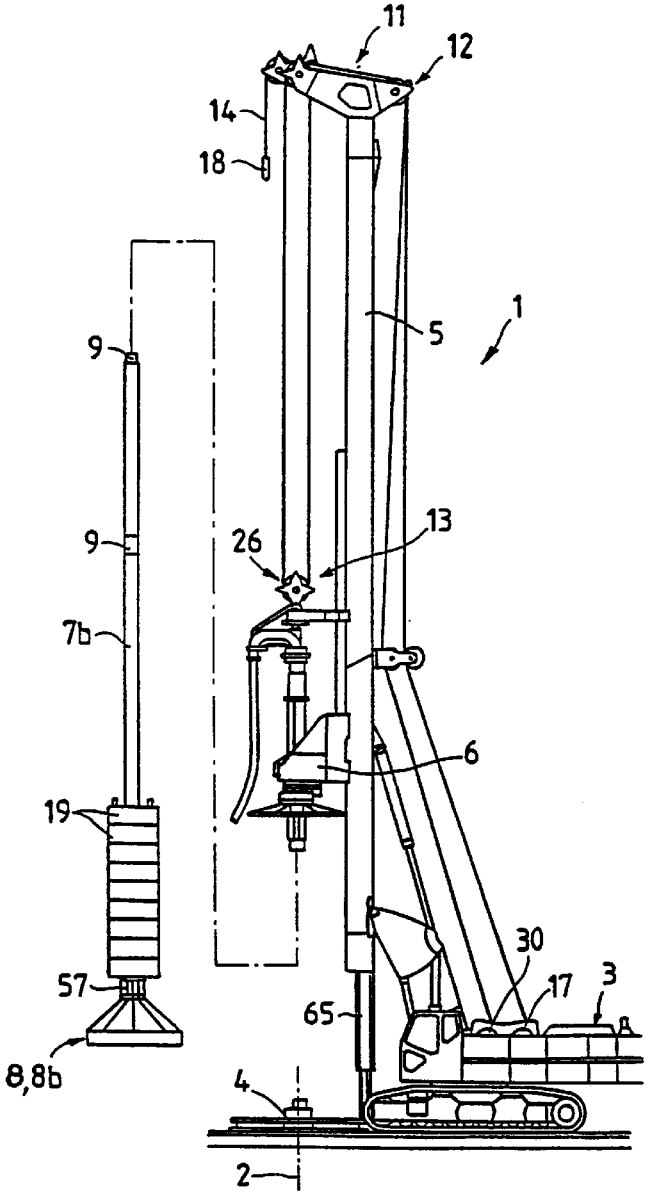
Fig.2

BORING UNIT FOR PILE FOUNDATIONS

TECHNICAL FIELD

The present invention relates to a boring unit for pile foundations.

BACKGROUND

Excavations in the pile foundation sector are carried out via two different methods according to the kind of terrain—soft or hard—in which the excavation has to be carried out, and the two different methods therefore involve two different kinds of boring units.

Boring units of a well known type which are used for excavating soft terrain usually comprise a tracked vehicle, a mast which is supported by the vehicle, a rotary table which is slidingly mounted along the mast, and a telescopic rod, which is caused to rotate by the rotary table and which presents a boring tool at a lower end, the boring tool being suitable for breaking up the terrain and collecting the debris.

Boring units used for excavating soft terrain also comprise a head mounted on top of the mast, and present a single cable which is suitable for moving the telescopic rod and the tool between a lowered position for excavation, in which the tool is placed against the bottom of the hole, and a raised position for unloading, in which the tool is arranged outside the hole to permit the emptying of the debris.

In general, on the other hand, the boring units of a well known type which are used for excavating hard terrain comprise a fixed platform at the mouth of the hole, a determined number of hydraulic pistons which are supported by the platform, a rotary table which is incorporated into the platform, and a number of excavation rods, which are composed of hollow elements that may be coupled together by means of flanges, and which support at a lower end a boring tool which is suitable for breaking up the terrain.

The excavation rods used in the kind of boring units for hard terrain as described above are moved by the above-mentioned hydraulic pistons, the movement of which effects the depth of the excavation, and the boring units must also be equipped with centering devices and ballast for weighing down the tool. Furthermore, these kinds of units and their relative equipment are moved by a crane provided with a mast, and a head mounted on a top end of the mast itself, and presenting a hoist for effecting movement.

SUMMARY

According to what has just been described above, it is quite obvious that carrying out some kinds of boring operations for pile foundations means that two kinds of different boring units must be used and that, furthermore, a crane must also be used, all of which means that it takes a long time to perform the excavation and that the costs are relatively high.

In The aim of the present invention is to produce a boring unit for pile foundations, which will permit the optimisation of the time needed for the excavation and which will also permit a considerable saving in terms of the machinery and equipment to be used.

According to the present invention, a boring unit for pile foundations will be realised comprising a platform facing the mouth of a hole, a mast which is supported by the platform, a rotary table slidingly mounted along the mast, and at least one excavation element which is connected to the table and which presents a boring tool at its lower end; the unit being characterised by the fact that it comprises a handling device of the excavation element and further auxiliary excavation elements which in turn comprise a head which is mounted at a top end of the mast, and which is provided with a hoist that may be connected to the excavation element, and which is also provided with a central cable which is suitable for moving the excavation element alternatively to the hoist between a lowered working position, in which the excavation element itself is arranged inside the hole, and a raised working position, in which the excavation element is arranged substantially outside the hole; the handling device also comprises a drive unit which is suitable for cooperating with the said hoist in order to rapidly move the auxiliary excavation elements.

DESCRIPTION OF THE DRAWINGS

The invention will now be described with reference to the attached drawings, which illustrate a non-limiting form of embodiment of the invention, in which:

FIG. 1 is an elevated side view of a preferred form of embodiment of the boring unit for pile foundations according to the present invention in a first working configuration for excavation;

FIG. 2 is an elevated side view of the unit shown in FIG. 1 in a second working configuration for excavation;

DETAILED DESCRIPTION

Figure 3:
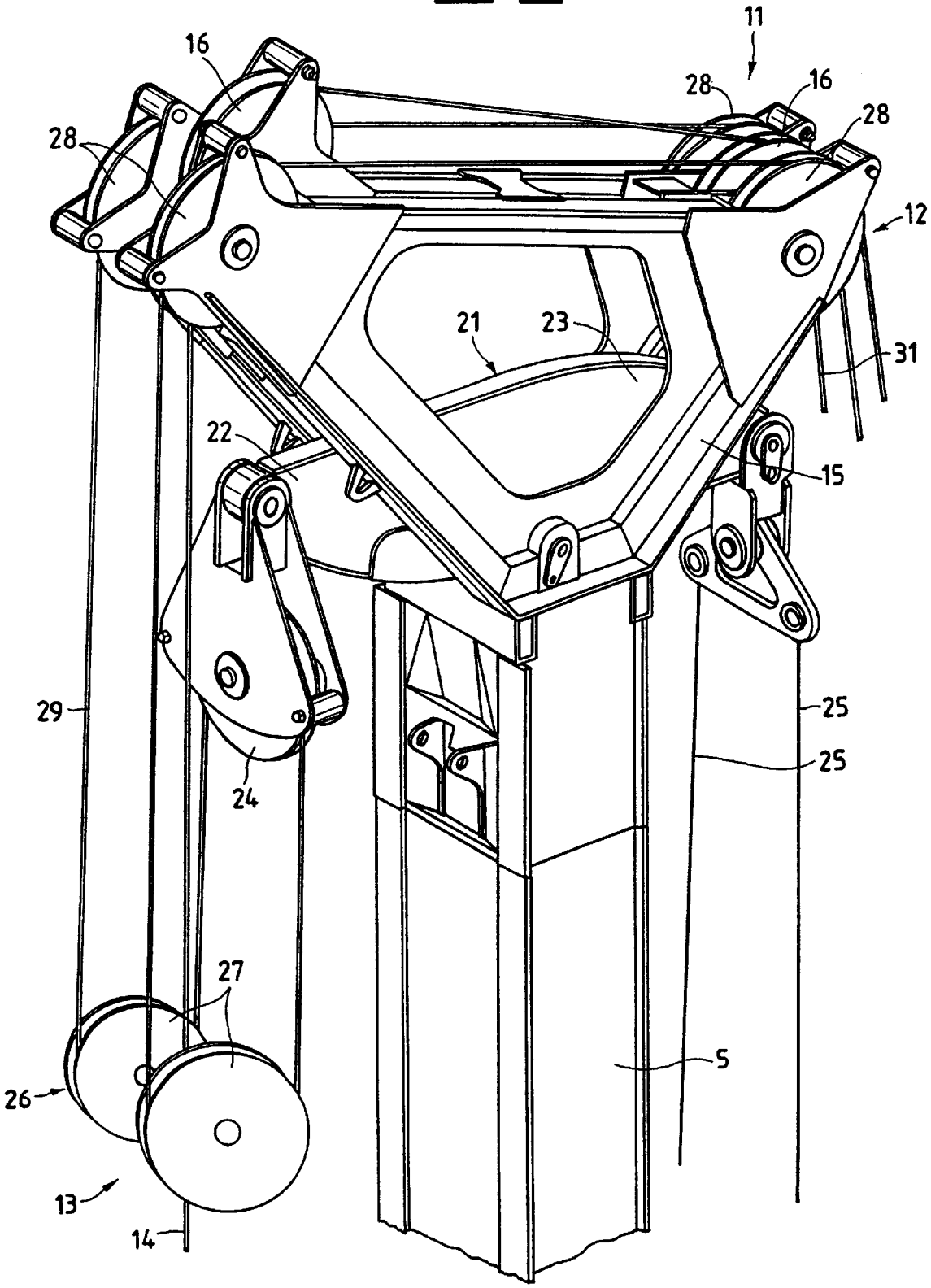
FIG. 3 is a prospect view on an enlarged scale of a detail of the unit shown in FIG. 1.

With reference to FIGS. 1 and 2, the number 1 indicates, in its entirety, a boring unit which is suitable for carrying out an excavation 2 for pile foundations in terrain which is initially soft and then hard.

The boring unit 1 comprises a platform 3 which is defined by a tracked vehicle facing the mouth 4 of the excavation 2, a mast 5 which is supported by the platform 3 itself, a rotary table 6 which is slidingly mounted along the mast 5, and at least one excavation element 7 connected to the table 6 and presenting at a lower end a boring tool 8. According to the kind of terrain to be excavated, the excavation element 7 will be defined by a telescopic rod 7*a* (FIG. 1) which is caused to rotate by the table 6 in order to break up the terrain and collect the debris, or by a boring rod 7*b* (FIG. 2) which is composed of a respective hollow element which can be coupled to further hollow elements by means of hexagonal joints 9 with two pins.

The unit 1 also comprises a handling device 11, for moving the excavation element 7, which in turn comprises a head 12 which is mounted on a top end of the mast 5, and which is provided with a hoist 13 which can be connected to the excavation element 7, and a central cable 14 which is suitable for moving the excavation element 7 alternatively.

to the hoist 13 between a lowered working position, in which the excavation element 7 itself is arranged inside the excavation 2, and a raised working position, in which the excavation element 7 is arranged substantially outside the excavation 2.

According to the illustration shown in FIG. 3, the head 12 comprises a support frame 15 which is mounted on the top end of the mast 5, and two transmission pulleys 16 for the cable 14 which are revolvingly supported by the frame 15 in order to rotate around respective horizontal rotation axis.

The frame 15 presents a substantially triangular shape, and is mounted with one angle of the triangle integral with the mast 5, and with the other two angles of the triangle arranged to the front and rear of the mast 5 itself. The cable 14 presents a branch that extends between a winch 17, which is arranged on the platform 3, and the side pulley 16, and another branch that extends between a hooking element 18 which is suitable for rendering the cable 14 itself and the rod 7*a* integral in relation to each other.

The hoist 13 is suitable for being used alternatively to the cable 14 in order to move one or more of the rods 7*b* and, as will be better explained below, to move the relative auxiliary excavation elements, such as the ballast 19 (FIG. 4) or the centering devices (FIG. 6) which are suitable for preventing any bending in the rod 7*b*.

The hoist 13 comprises a swinging beam 21 which is hinged to the mast 5 inside the frame 15 and which presents two swinging arms 22 and 23 which are aligned in relation to each other, and of which the arm 22 is an front arm supporting a pulley 24 with a horizontal axis which is transverse to the axis of the pulleys 16, while the arm 23 is a rear arm which is connected to the platform 3 by means of two balancing stays 25.

The hoist 13 also comprises a lower mobile crosspiece 26 which is provided with two revolving blocks 27 which revolve around a common horizontal rotation axis which is transverse to the rotation axis of the pulley 24, the hoist 13 also comprises four pulleys 28 which are mounted side by side in pairs on the frame 15 and which include in the middle of each pair a relative pulley 16 in order to rotate around a respective horizontal rotation axis which is parallel to the axis of the pulleys 16 themselves.

The hoist 13 also comprises, finally, a main cable 29, which is wound around a respective winch 30 arranged on the platform 3, then around a first pair of pulleys 28 aligned in relation to each other, then around a block 27 and a pulley 24, then around the other block 27 then around the other pair of pulleys 28, which are aligned in relation to each other, until it arrives at a fixed cable terminal 31 which is arranged, once again, on the platform 3. The transmission of the cable 29 is defined by four cables with the same working centre as the cable 14, and once hooked to the rod 7*b* it permits the movement of heavy weights without necessarily having to make use of a high power winch 30.

In fact, when excavations are being carried out in soft terrain, it is sufficient to use a telescopic rod 7*a* which is controlled in its ascent and descent by the cable 14, while when excavations are being carried out in hard terrain, it is sufficient to use one or more rods 7*b* which are moved and equipped with ballast 19 and centering devices 20 by means of the hoist 13, which may be easily substituted for the cable 14 in very little time.

Figure 4:
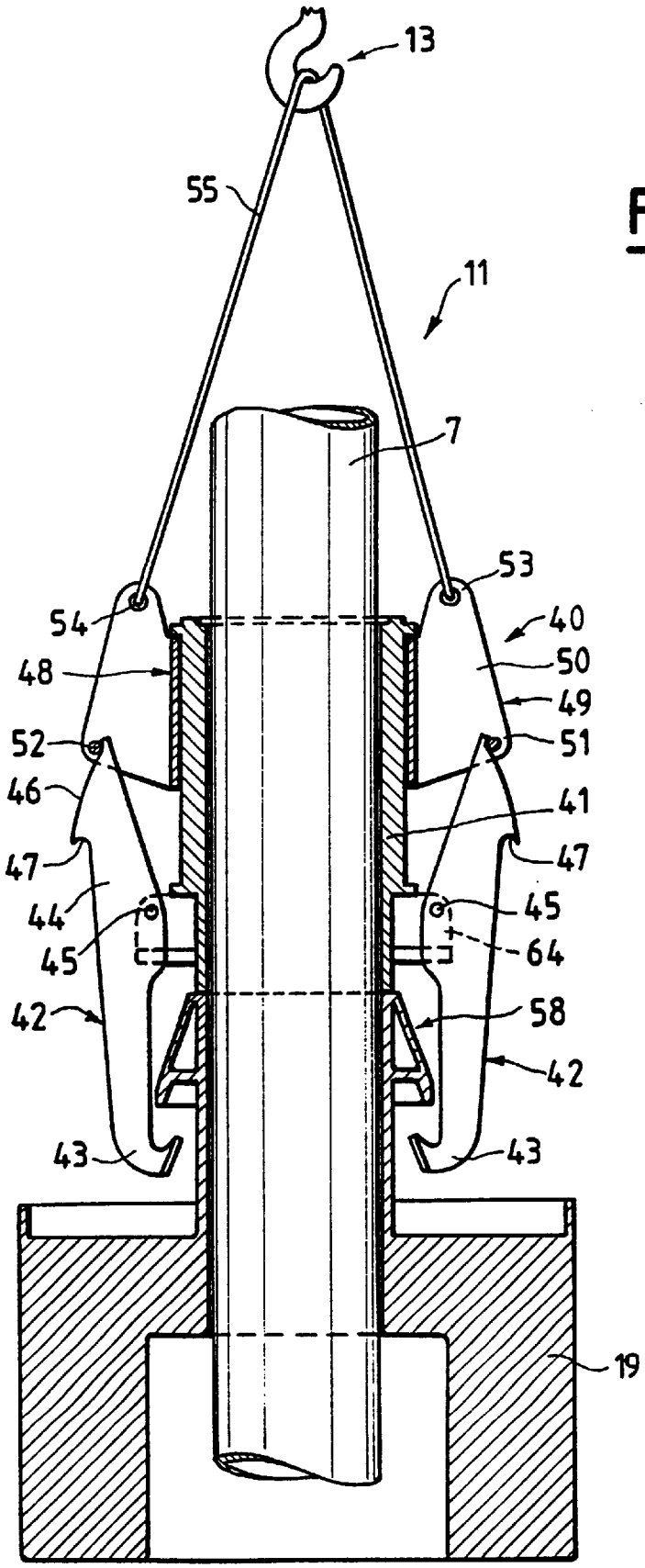
FIGS. 4 and 5 are axial section views on an enlarged scale of a detail shown in FIG. 1 in a closed working position and, respectively, in a wide open disengaged working position.
Figure 5:
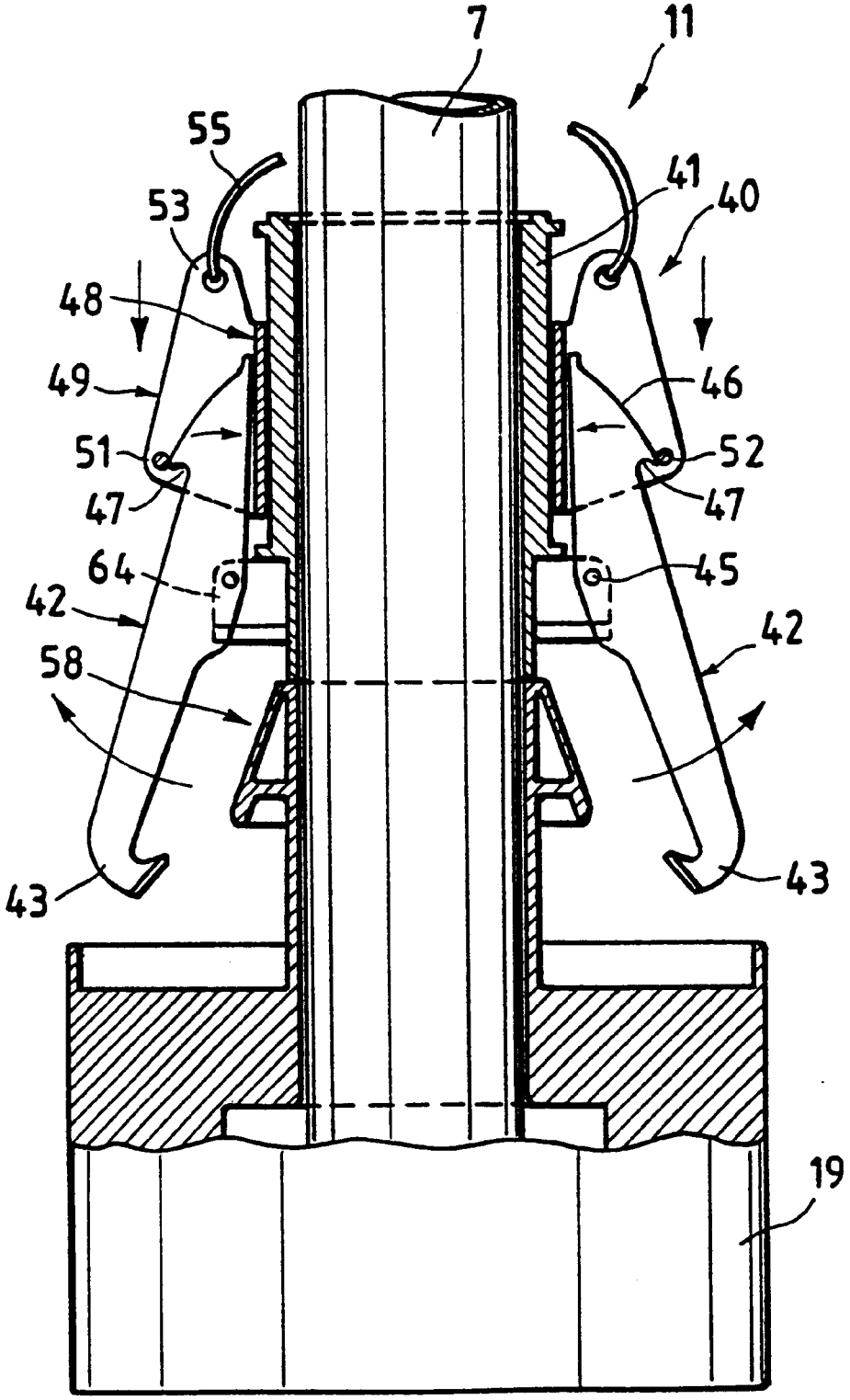
Figure 6:
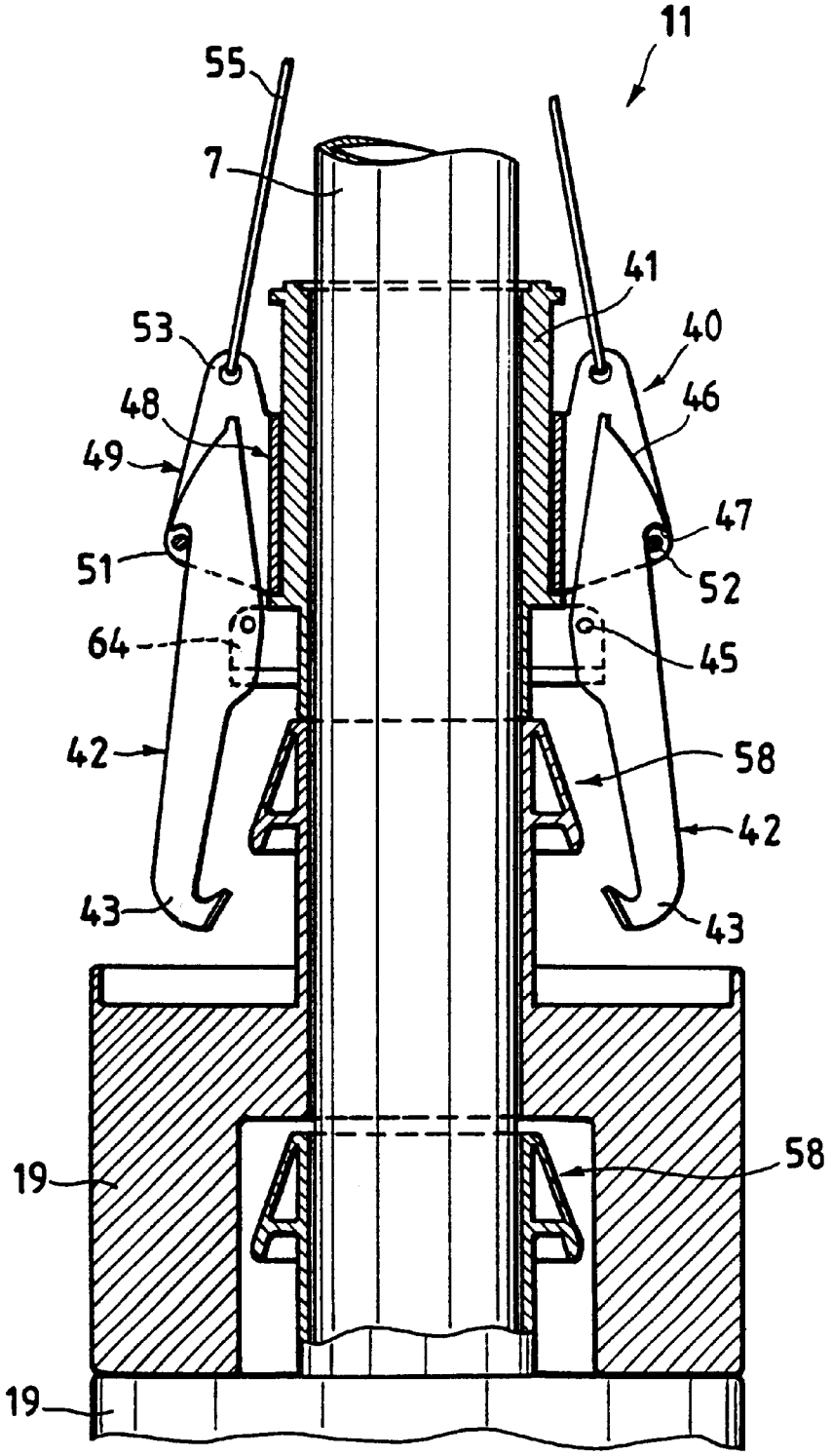
FIG. 6 is an axial section view of the detail shown in FIGS. 4 and 5 in a semi-closed working position.

The movement of the ballast 19 directly inside the excavation 2 occurs, as illustrated in FIGS. 4, 5 and 6, by means of a drive unit 40, which is part of the handling device 11 and which is raised and lowered by the hoist 13 for the rapid movement of the rods 7*b* and the aforementioned auxiliary excavation elements.

The drive unit 40 comprises a tubular coupling 41 which is suitable for sliding along the sides of the rods 7*b*, and three or four hooks 42 which are hinged to the coupling 41 itself in order to swing between a closed working position, as illustrated in FIG. 4, and a wide open disengaged position as illustrated in FIG. 6. Each hook 42 comprises a hooked arm 43 and a shaped arm 44 which are arranged opposite respective hinging points 45, of which the hooked arm 44 presents a cam-shaped outline 46, and a blocking housing 47.

The drive unit 40 also comprises a tubular collar 48, which is slidingly axially coupled to the coupling 41 between a raised working position as illustrated in FIG. 4 and a lowered working position as illustrated in FIG. 5, and is engaged with each of the shaped arms 44 in order to make the hooks 42 swing around the respective hinging points 45. The collar 48 presents, for each hook 42, a radial wing 49 defined by two plates 50 which face each other. The radial wing 49 is provided, in correspondence to a lower external end 51, with a respective roller 52 which is supported between the two plates 50, and, in correspondence with an upper end 53, with a hole 54 which passes through both the plates 50 and which is suitable for being connected by means of a cable 55 to the other holes 54 of the other wings 49 to the hoist 13.

Each arm 44 is inserted inside the two relative plates 50, and the balancing of each hook 42 is such that the working position of each hook 42 when free of external restraints corresponds with the relative closed working position, in which the hooked arms 43 are arranged near to each other.

The axial movement of the collar 48 with regard to the coupling 41, and in particular the downward sliding of the collar 48 along the coupling 41 itself, determines the movement of the rollers 52 along the outlines 46 of the relative arms 43, the relative hooks 42 move from their relative closed working positions towards their relative wide open working positions. A further sliding of the collar 48 in relation to the coupling 41 determines a movement of the rollers 52 beyond the relative housings 47 causing the hooks 42 to swing briefly towards a relative semi-wide open position as illustrated in FIG. 6, and the successive upward movement of the collar 48 causes the engagement of the rollers 52 in the relative housings 47 and the definitive blocking of the hooks 42 in their semi-wide open working positions.

Figure 7:
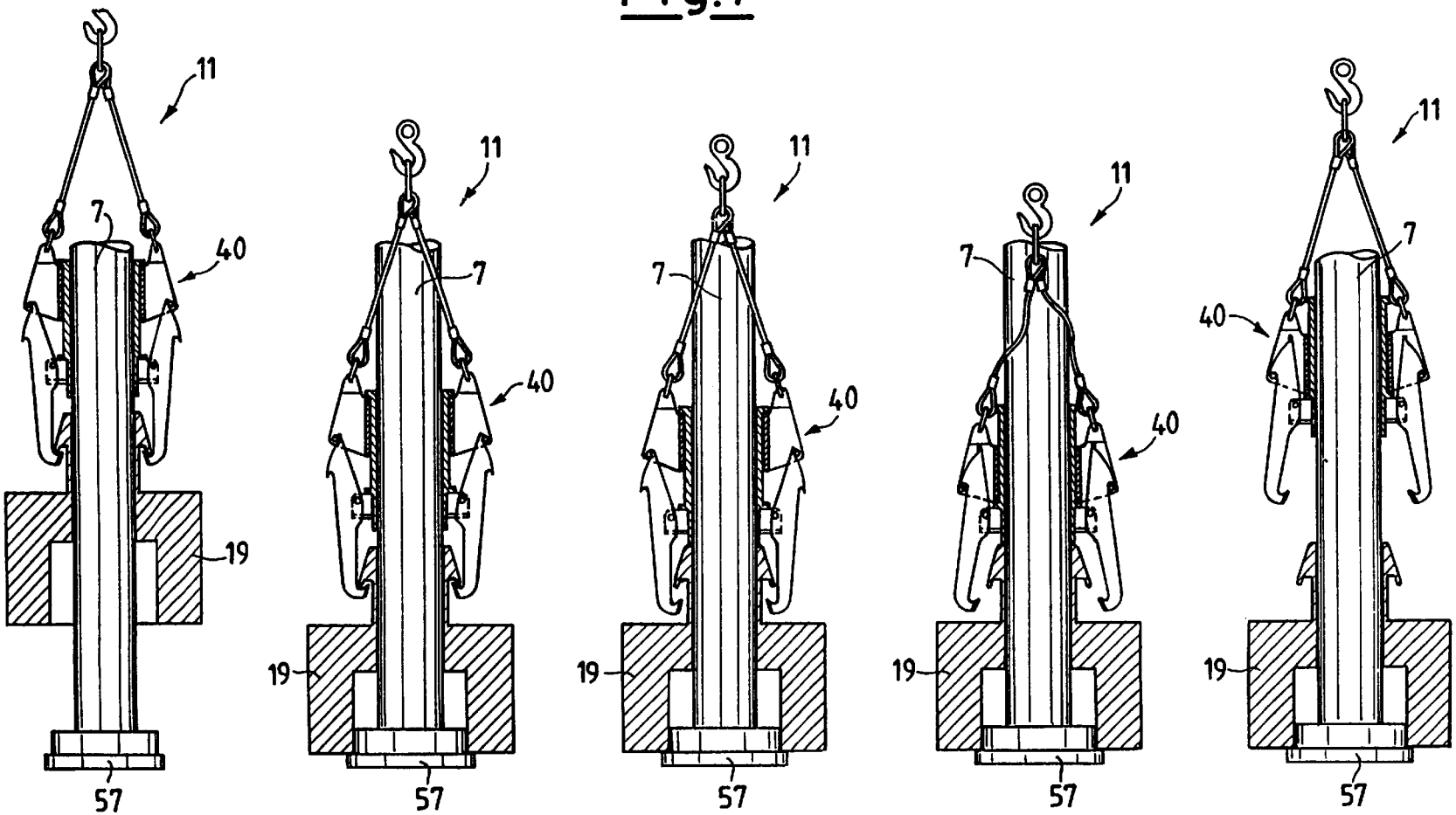
FIG. 7 illustrates, in axial section, a functioning sequence of the detail shown in FIGS. 4, 5 and 6.
Figures 7A, 7B, 7C, 7D, 7E:
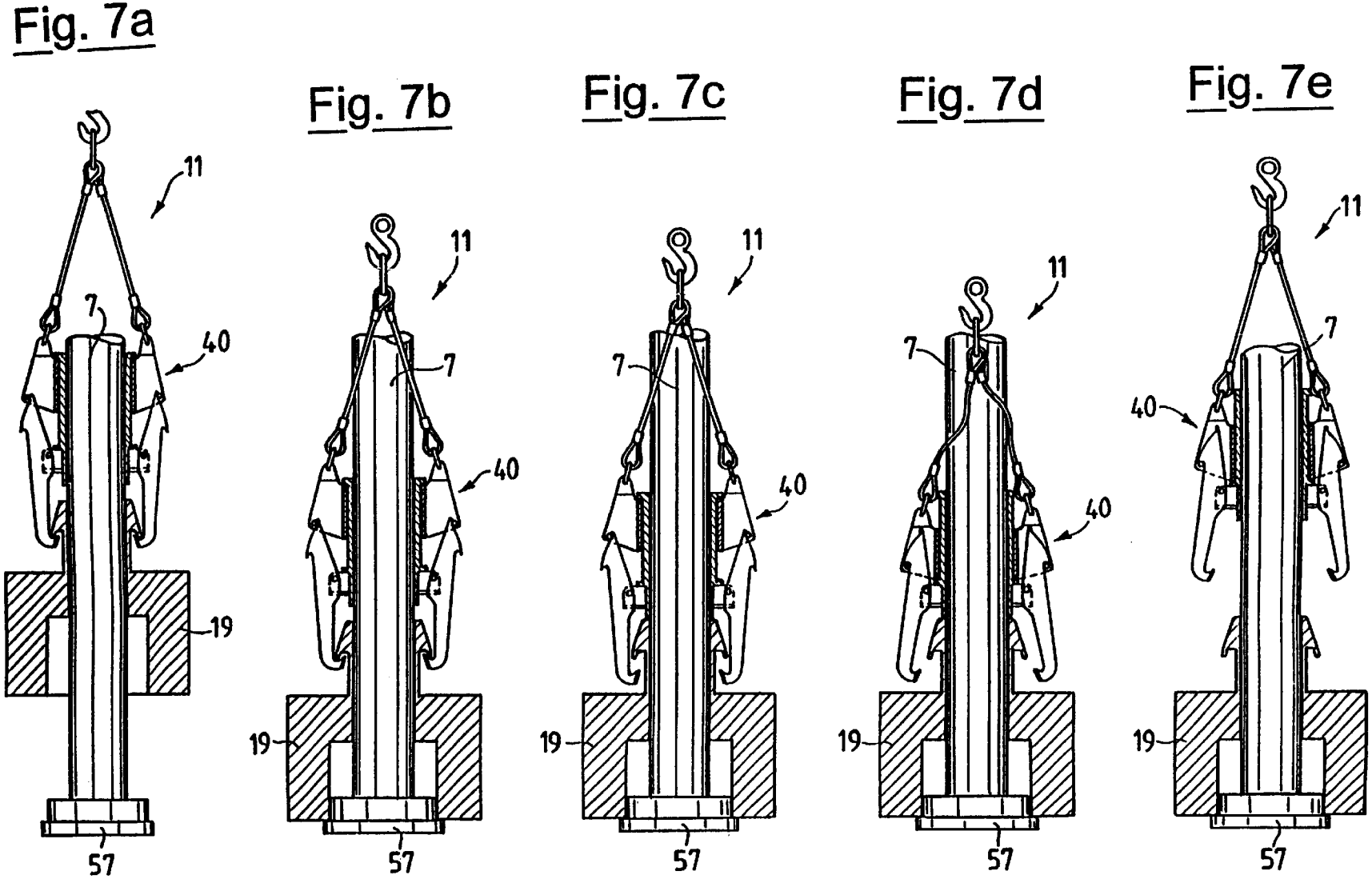

According to the illustration shown in FIG. 7, each of the rods 7*b* is composed of a respective hollow element which can be jointed to further hollow elements by means of the joints 9, and the relative tool 8*b* is provided with an external shoulder 57 which defines a support base for a piece of ballast 19, the doughnut shape of which renders it ideal for being inserted along a rod 7*b* and being pushed by the drive unit 40 to lean over the shoulder 57 itself. Each ballast 19 is provided at the top with a steel head 58 which is suitable for being gripped by the drive unit 40 itself with the hooks 42 arranged in the closed working position.

Figure 8:
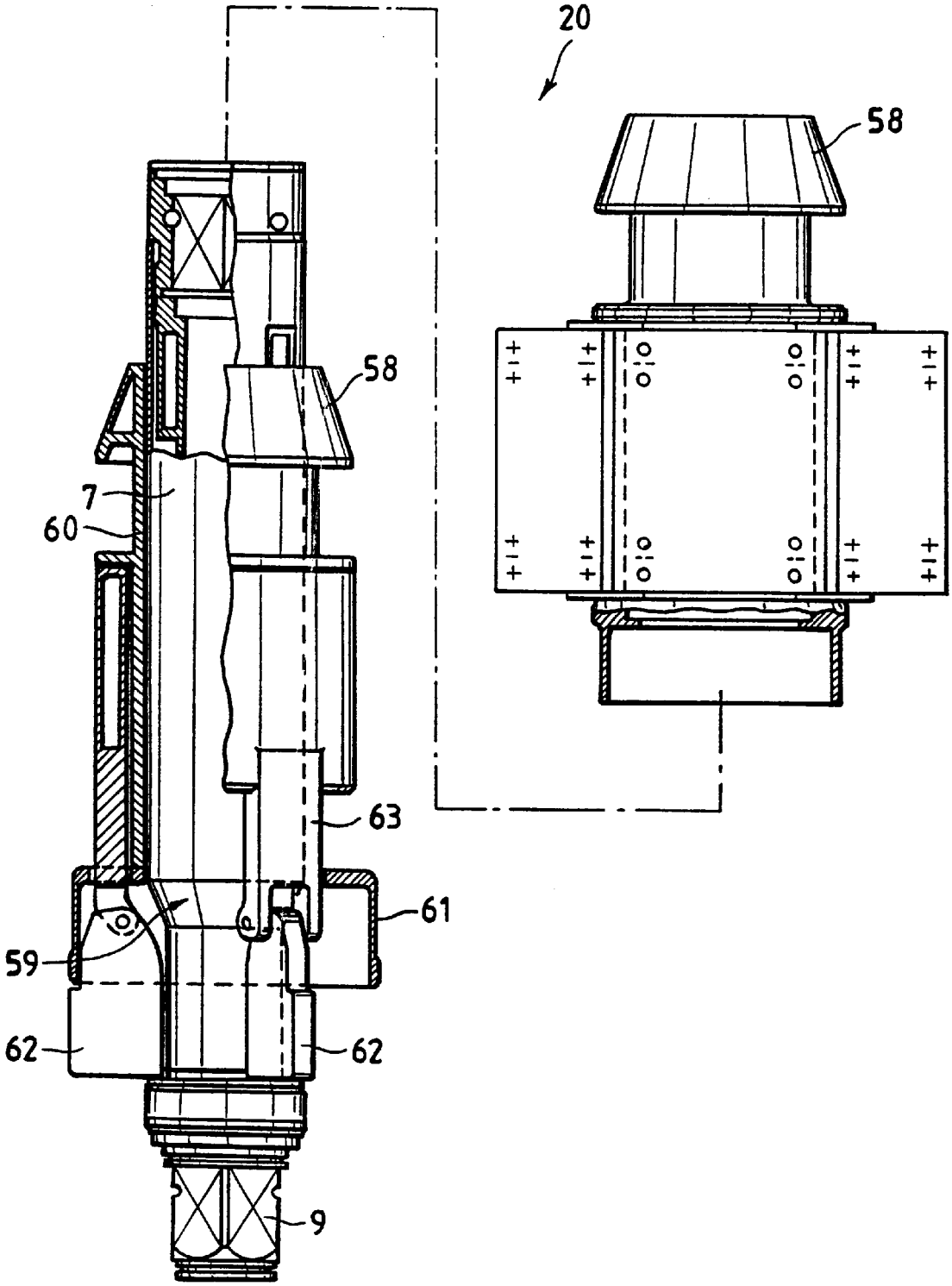
FIG. 8 shows an axial section view on an enlarged scale of a detail of the unit shown in FIG. 2.
Figures 9A, 9B, 9C, 9D:
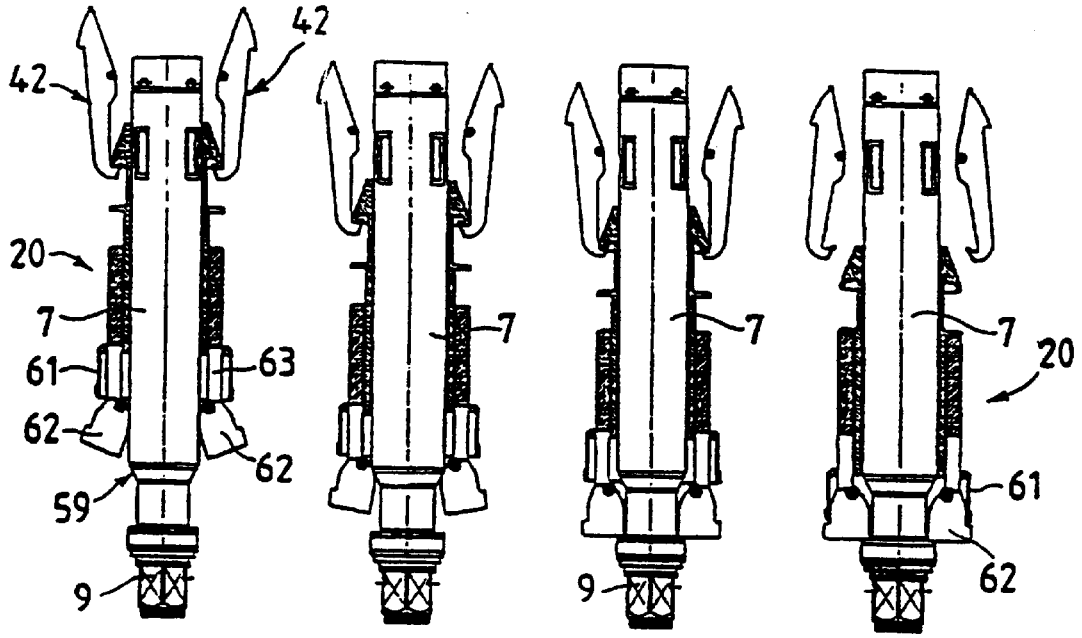
FIGS. 9 and 10 illustrate two respective functioning sequences of the detail shown in FIG. 8 in two functioning working conditions.

According to the illustrations shown in FIGS. 8 and 9, each of the rods 7*b* comprises, substantially in correspondence to the relative joints 9, an annular groove 59 which defines a support housing for a centering device 20, which is in turn provided with a steel head 58 which is suitable for being gripped by the drive unit 40, and is also provided with a respective collar 60 which is integral to the relative head 58, and is suitable for sliding along the rod 7*b*.

The centering device 20 also comprises a cap 61 which is integral to the collar 60 and is axially arranged on the collar 60 itself opposite the relative head 58, and three or four gripping pawls 62 which are suitable for being blocked by the cap 61 itself in an engaged working position inside the groove 59. Each pawl 62 is hinged onto a tubular element 63 which is slidingly axially coupled to the relative collar 60 and is moved by means of the cap 61, and presents an internal outline of such a shape as to cause the pawls 62 themselves to swing around the relative hinges in correspondence to the groove 59. In particular, the axial dimension of the groove 59 is such as to permit the transit of a centering device 20 the pawls 62 of which present a height which is greater than the axial dimension of the groove 59 itself, and is such as to permit the pawls 62 to swing completely inside the groove 59 and, thus, to block the centering device 20, the pawls 62 of which present a height which is less than the axial dimension of the groove 59 itself.

In use, once the platform 3 has been positioned in front of the place where the excavation 2 is to be carried out, and once the mast 5 has been raised to a vertical position, a first phase of excavation is proceeded to using the telescopic rod 7*a* for a minimum depth of about ten meters down into the excavation 2 itself. The rod 7*a* needs to be removed from the excavation 2 so that debris can be removed, and this operation is carried out by using the central cable 14 which is hooked to the rod 7*a* itself by means of the element 18 and which is moved by the winch 17.

Once the depth of the excavation is such that the use of the rod 7*a* is no longer possible due to the hardening of the terrain, and without the use of the usual service crane, it is possible to replace the rod 7*a* with a different excavation element, that is the element 7*b* which is defined by one or more rods 7*b* aligned in relation to each other and connected by means of the joints 9. The boring tool 8*b* is mounted on the lower end of the series of rods 7*b,* the aforementioned tool 8*b* needs a special kind of ballast in order to be able to operate in hard terrain. In order to achieve this aim, once the rod 7*b* has been hooked to the crosspiece 26 of the hoist 13, the boring tool 8*b* is rested on the bottom of the excavation 2, it is then weighted down by adding the ballast 19 one piece after another.

Once a support base 65 of the mast 5 has been inserted into the terrain in order to give more stability to the mast 5 itself, the loading of the ballast 19 onto the boring tool 8 is carried out from the drive unit 40 in the following manner and starting from an elongated configuration of the drive unit 40 itself, in which the collar 48 is maintained in a raised position in relation to the coupling 41 of the cable 55 and the hooks 42 are arranged in their closed working position with the rollers 52 arranged in correspondence to the upper end of the relative outlines 46 opposite the housing 47.

Starting from this configuration, the drive unit 40 is lowered onto a piece of ballast 19 and the arms 43 are gradually widened by the head 58 until the coupling 41 comes into contact with the head 58 itself. At this point, without lowering the collar 48 any further, the arms 43 return to their closed working position due to the effect of their being balanced and the subsequent raising of the collar 48 determines the engagement of the arms 43 with the underneath part of the head 58 and, thus, the raising of the ballast 19 which, at this point, can be lowered into the excavation 2.

When the ballast 19 comes to rest on the shoulder 57 of the boring tool 8*b,* the collar 48 is lowered until it rests against a crown 64 to which the hooks 42 are hinged. The lowering of the collar 48 determines the movement of the rollers 52 at the same time onto the outlines 46 and, thus, the movement of the hooks 42 towards the respective wide open working position. The fact of the rollers 52 coming out of the relative outlines 46 determines the movement of the hooks 42 toward the semi-wide open working position, and the subsequent raising of the drive unit 40 means that the rollers 52 are engaged inside the housings 47 so that the hooks 42 are blocked in this final position which permits the arms 43 to withdraw in relation to the head 58.

The removal of the ballast 19 is carried out in substantially the reverse order in which it was loaded: a drive unit 40 in its elongated configuration is lowered into the excavation 2, it is then brought to rest with the relative coupling 41 positioned on a head 58 causing the arms 43 to open wide and subsequently engage with the head 58 itself. In order to prevent the accidental hooking of the rollers 52 into the housing 47, the aforementioned rollers 52 are disassembled throughout the entire disassembly operation.

Once the ballast 19 has been hooked, it may be easily extracted from the excavation 2.

The centering devices 20 are moved along the rods 7*b* in a substantially similar way to that in which the ballast 19 is moved, above all as regards the configuration of the drive unit 40.

FIG. 9 illustrates an insertion sequence of a centering device 20, the pawls 62 of which present a height which is less than the dimension of the groove 59 of the rod 7*b.* When a centering device 20 is lowered onto a rod 7*b,* it is gripped by the relative head 58 of the drive unit 40 and is arranged in a working configuration for insertion, in which the collar 60 is maintained in a raised position in relation to the relative tubular element 63, and the pawls 62 are maintained in a wide open position due to the action of the relative internal outlines on the sides of the rod 7*b.*

When the sliding of the opening device along the rod 7*b* brings the pawls 62 to the height of a groove 59, the pawls 62 themselves swing in order to become inserted into the groove 59 itself, and given that their height is less than the axial dimension of the groove 59 they become inserted while blocking the downward slide of the centering device 20 itself. Once the pawls 62 are inserted inside the groove 59, the subsequent lowering of the collar 60 determines the slide of the cap 61 onto the pawls 62 themselves as well as the final blocking of the centering device 20 and the axial blocking of the head 58, which permits the disengagement of the drive unit 40 in the manner which has previously been described for the ballast 19.

The extraction of a centering device 20 from the rod 7*b* takes place by lowering a drive unit 40 onto the head 58 of the centering device 20 itself and engaging the arms 43 with the same head 58. The raising of the centering device 20 by the drive unit 40 determines the re-positioning of the centering device 20 itself in its working position for. insertion which allows it to be extracted.

Figures 10A, 10B, 10C, 10D:
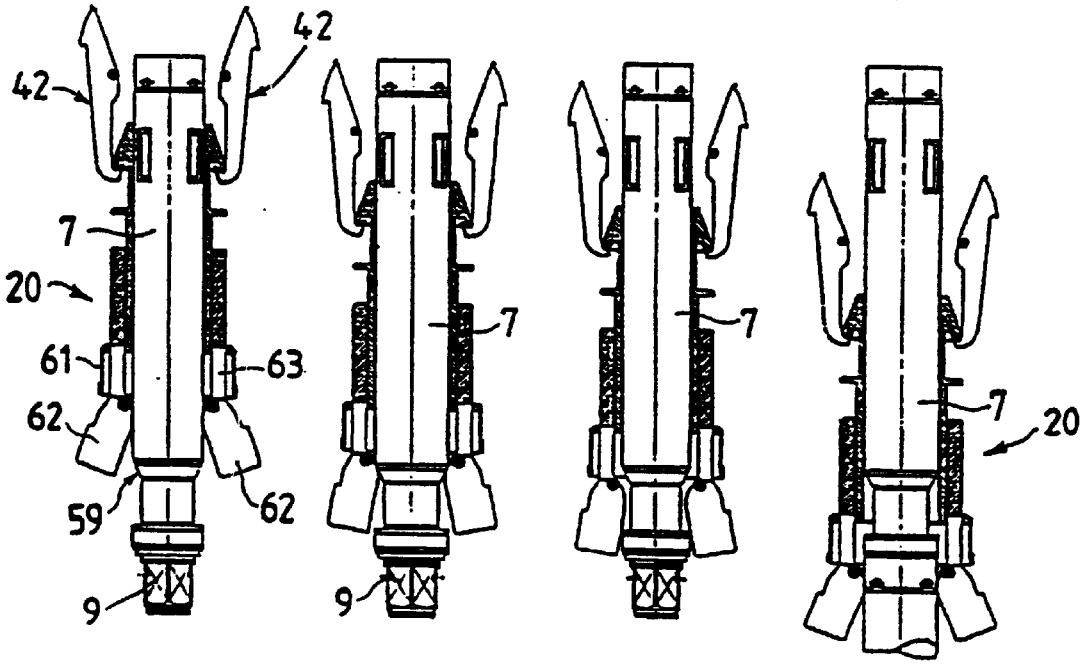

FIG. 10, instead, illustrates an insertion sequence for a centering device 20, the pawls 62 of which present a height which is greater than the axial dimension of the groove 59 of the rod 7*b.* In this case, when the slide of the opening device along the rod 7*b* brings the pawls 62 to the height of a groove 59, the pawls 62 themselves swing in order to become inserted into the groove 59 itself, but given that their height is greater than the axial dimension of the groove 59 they are not inserted to block the downward movement of the centering device 20 itself, which can therefore be positioned more deeply in the excavation 2.

It is obvious from the foregoing description that the adoption of the handling device 11 permits notable savings in terms of equipment and, above all, in terms of working time, in that the use of the single device 11 means that it is possible to configure the unit 1 for both soft and hard terrain as well as to move the ballast 19 and the centering device 20 without using any auxiliary external units.

It is intended that the invention not be limited to the form of embodiment herein described and illustrated, which is to be considered as an example of an embodiment of the boring unit for pile foundations, which may be subject to further modifications relating to the shape and arrangement of the parts and to details pertaining to construction and assembly.

What is claimed is:

1. Boring unit (1) for pile foundations comprising a platform (3) facing a mouth of a hole, a mast (5) which is supported by the platform (3), a rotary table (6) slidingly mounted along the mast (5), and an excavation element which is connected to the table (6) and which presents a boring tool (8) at its lower end; the unit (1) comprising a handling device (11) of the excavation element (7) and further auxiliary excavation elements (19, 20) which in turn comprise a head (12) which is mounted at a top end of the mast (5), and which is provided with a hoist (13) that is configured to be connected to the excavation element (7), and which is also provided with a central cable (14) which is configured for moving the excavation element (7) alternatively to the hoist (13) between a lowered working position, in which the excavation element (7) is arranged inside the hole, and a raised working position, in which the excavation element (7) is arranged substantially outside the hole; the handling device (11) also comprising a drive unit (40) which is configured to cooperate with the hoist (13) in order to rapidly move the auxiliary excavation elements (19, 20), and wherein the hoist (13) comprises a support frame (15) which is mounted on top end of the mast (5), a first and a second pair of pulleys (28) which are mounted side by side in relation to each other on the frame (15) in order to rotate around a respective horizontal rotation axis, a swinging beam (21) which is centrally hinged onto the mast (5) inside the frame (15) between the first and second pair of pulleys (28) and which is provided with two revolving blocks configured to rotate about a common horizontal rotation axis which is transverse to the rotation axis of a relevant pulley (24) of the beam (21).

2. Unit according to claim 1, wherein the excavation element (7) is defined by a telescopic rod **(7*a*) which is caused to rotate by the rotary table (6), and the boring tool (8*a*)** is suitable for breaking up the terrain and collecting debris.

3. Unit according to claim 2, wherein the central cable (14) is provided with a hooking element (18) which is configured to couple the central cable (14) and the telescopic rod **(7*a*)**.

4. Unit according to claim 3, wherein the head (12) comprises a support frame (15) which is mounted on the top end of the mast (5), and two transmission pulleys (16) for the central cable (14) which are revolvingly supported by the frame (15) in order to rotate around a respective horizontal rotation axis.

5. Unit according to claim 1, wherein the hoist (13) comprises two balancing stays (25) which are hooked to a free end of the swinging beam (21) opposite to the relevant pulley (24).

6. Unit according to claim 1, wherein the drive unit (40) comprises a tubular coupling (41) which is configured to slide along the excavation element (7), and at least two hooks (42) which are hinged to the coupling (41) in order to swing between a closed working position and a wide open disengaged working position, each of at least two hooks including a hooked arm (43) and a shaped arm (44) which are arranged opposite a respective hinging point (45).

7. Unit according to claim 6, wherein the drive unit (40) comprises a tubular collar (48) which is slidingly mounted to the coupling (41) between a collar raised working position and a collar lowered working position, and which is engaged by each of the shaped arms (44) of the at least two hooks (42) in order to make each of the hooks (42) swing around their respective hinging points (45).

8. Unit according to claim 7, wherein each shaped arm (44) is cam-shaped and is configured to cooperate with a respective roller (52) which is revolvingly supported by the tubular collar (48) in a downward direction from the collar raised working position towards the collar lowered working position, and a blocking housing (47) of the roller (52) being configured to house the respective roller (52) when the collar (48) is at least arranged in the collar lowered working position.

9. Unit according to claim 8, wherein the excavation element (7) is defined by a boring rod **(7*b*) composed of a respective hollow element which is configured to be jointed to further hollow elements and to said boring tool (8) by means of connecting joints (9), the boring tool (8) presenting a support base (57) for an auxiliary excavation element (19) which is provided with a steel head (58) which is configured to be gripped by said drive unit (40) in order to move at least one of the auxiliary excavation elements (19) along the boring rod (7*b*)**.

10. Unit according to claim 9, wherein each boring rod **(7*b*) comprises, substantially in correspondence to the relative joint (9), an annular groove (59) which defines a housing for a centering auxiliary excavation element (20) which centers the boring rod (7*b*), and wherein the centering auxiliary excavation element (20) comprises a respective steel head (58) which is configured to be gripped by the drive unit (40) so that the respective steel head is moved along the boring head (7*b*), and a respective collar (60) which is integral to the relative head (58) and which is configured to be slid along the boring rod (7*b*)**.

11. Unit according to claim 10, wherein the centering auxiliary excavation element (20) comprises a cap (61) which is integral to the collar (60) and which is axially arranged on the collar (6) opposite the relative head (58), and at least two swinging blocking elements (62) which are configured to be blocked by the cap (61) in an engaged working position inside the said groove (59); the swinging elements (62) being hinged onto a tubular element (63) which is axially and slidingly coupled to the relative collar (60) and which is moveable across the cap (61).

12. Unit according to claim 11, wherein the grooves (59) present an axial dimension which is substantially equal to or substantially less than a height of the swinging element (62) to permit the engagement of the swinging element (62) in relation to the groove (59).

13. Unit according to claim 1 wherein the platform (3) is defined by a tracked vehicle.

14. Unit according to claim 13, wherein the mast (5) comprises an extractable support base (65), which is arranged at a lower end of the mast (5).

15. Boring unit (1) for pile foundations comprising a platform (3) facing a mouth of a hole, a mast (5) which is supported by the platform (3), a rotary table (6) slidingly mounted along the mast (5), and an excavation element which is connected to the table (6) and which presents a boring tool (8) at its lower end; the unit (1) comprising a handling device (11) of the excavation element (7) and further auxiliary excavation elements (19, 20) which in turn comprise a head (12) which is mounted at a top end of the mast (5), and which is provided with a hoist (13) that is configured to be connected to the excavation element (7), and which is also provided with a central cable (14) which is configured for moving the excavation element (7) alternatively to the hoist (13) between a lowered working position, in which the excavation element (7) is arranged inside the hole, and a raised working position, in which the excavation element (7) is arranged substantially outside the hole; the handling device (11) also comprising a drive unit (40) which is configured to cooperate with the hoist (13) in order to rapidly move the auxiliary excavation elements (19, 20), wherein the drive unit (40) comprises a tubular coupling (41) which is configured to slide along the excavation element (7), and at least two hooks (42) which are hinged to the coupling (41) in order to swing between a closed working position and a wide open disengaged working position, each of at least two hooks including a hooked arm (43) and a shaped arm (44) which are arranged opposite a respective hinging point (45), and wherein the drive unit (40) comprises a tubular collar (48) which is slidingly mounted to the coupling (41) between a collar raised working position and a collar lowered working position, and which is engaged by each of the shaped arms (44) of the at least two hooks (42) in order to make each of the hooks (42) swing around their respective hinging points (45).

* * * * *